United States Patent [19]

Dawson

[11] Patent Number: 4,776,637

[45] Date of Patent: Oct. 11, 1988

[54] CUTTING MACHINES AND METHOD OF CONTROLLING THE CUTTING HORIZON

[75] Inventor: Gordon B. Dawson, Bawtry, Nr. Doncaster, England

[73] Assignee: B.M.D. Limited, Bedfordshire, England

[21] Appl. No.: 21,194

[22] Filed: Mar. 3, 1987

[30] Foreign Application Priority Data

Mar. 4, 1986 [GB] United Kingdom ..... 8605261

[51] Int. Cl.[4] ..... E21C 27/02

[52] U.S. Cl. ..... 299/1; 299/34; 299/43

[58] Field of Search ..... 299/1, 30, 32, 34, 43, 299/76

[56] References Cited

U.S. PATENT DOCUMENTS

| | | | |
|---|---|---|---|
| 3,339,981 | 9/1967 | Dommann et al. | 299/43 X |
| 3,388,948 | 6/1968 | Lobbe et al. | 299/34 |
| 3,407,002 | 10/1968 | Pidgeon | 299/1 |
| 3,489,460 | 1/1970 | Cooper | 299/1 |
| 3,804,465 | 4/1974 | Ostrop et al. | 299/34 |
| 3,915,500 | 10/1975 | Schlusener et al. | 299/32 |
| 4,013,320 | 3/1977 | Johns | 299/34 X |

FOREIGN PATENT DOCUMENTS

| | | | |
|---|---|---|---|
| 542737 | 6/1957 | Canada | 299/34 |
| 1196147 | 7/1965 | Fed. Rep. of Germany . | |
| 1283776 | 11/1968 | Fed. Rep. of Germany . | |
| 3200176 | 7/1983 | Fed. Rep. of Germany . | |
| 1164415 | 6/1985 | U.S.S.R. | 299/34 |
| 2113305 | 3/1983 | United Kingdom . | |

*Primary Examiner*—George A. Suchfield
*Assistant Examiner*—David J. Bagnell
*Attorney, Agent, or Firm*—Silverman, Cass, Singer & Winburn, Ltd.

[57] ABSTRACT

A cutting machine including a base, a cutter movably mounted on the base, and a drive for moving the cutter reciprocably along the base to carry out a cutting operation. The cutter height relative to the base is alterable by a ram and the base includes a controller for controlling the height of the cutter to set a desired height of the cutter relative to the base as the cutter passes the controller.

25 Claims, 11 Drawing Sheets

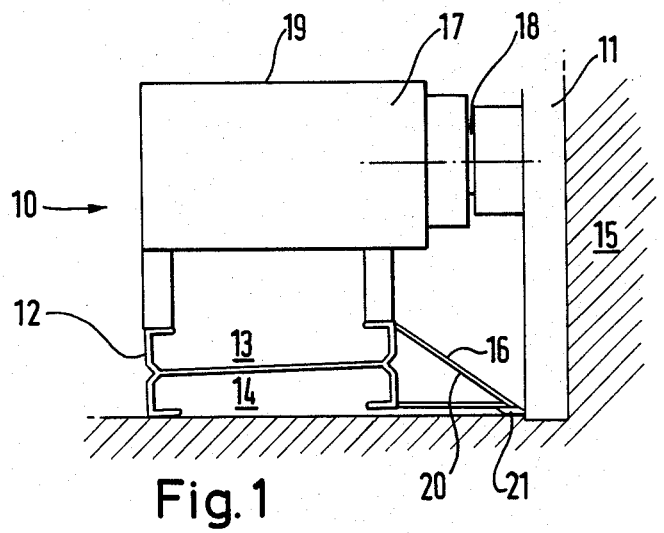
Fig. 1
Fig. 2A
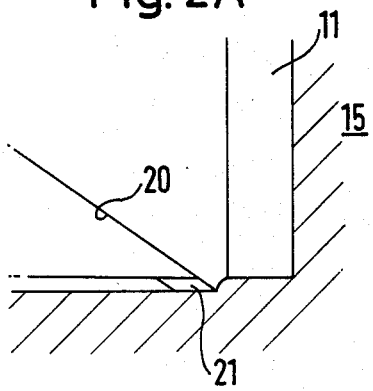
Fig. 2B
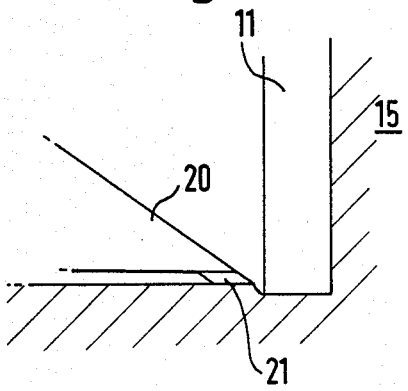

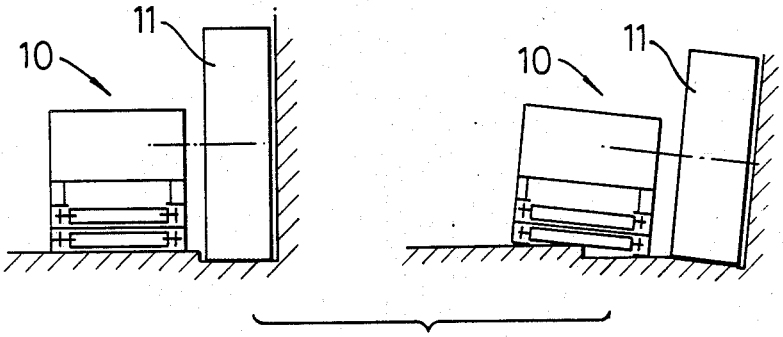
Fig. 3D
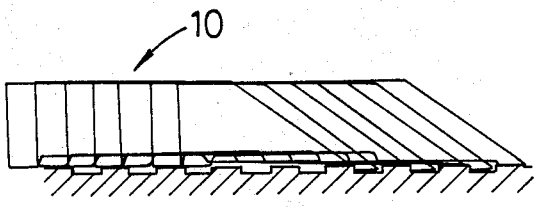
Fig. 3E
Fig. 4
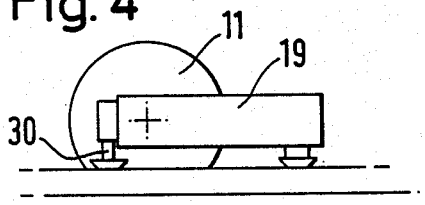

CUTTING MACHINES AND METHOD OF CONTROLLING THE CUTTING HORIZON

The invention relates to cutting machines, and more particularly but not exclusively machines for cutting coal and other sedimentary deposits from seams underground.

The technique of winning (mining) coal and other sedimentary deposits by mounting a cutting machine on or adjacent to a conveyor and arranging for the cutting machine to travel along the conveyor making successive cuts with a rotating cutting drum or drums, the product from which is simultaneously loaded onto the conveyor for ultimate transport to the surface is well known and extensively used. Sedimentary deposits are rarely level or consistent in gradient and in operation it is necessary to adjust the cutting horizon of the cutting machine to follow the seam or band. Adjustment is generally made by raising or lowering or tilting the plane of operation of the cutting element with respect to a cutting machine track, which is usually the conveyor or attached to the conveyor.

The operation is dependent on the skill of the driver whose vision of the cutting area is often limited by dust and machinery and who frequently has to make decisions whilst his machine is moving at 20 feet per minute or more. As a result it is not unusual to find that the steering function has been less than perfectly carried out and that production losses occur, or the product is contaminated with unwanted roof or floor materials, for example stone.

The floor cut by the passage of the cutting machine provides part of the floor on which the conveyor will be partly sitting for the next cut, if there is a difference in the horizon of the floor the conveyor may adopt a tilted posture which further complicates the driving/steering problem.

According to the invention, there is provided a cutting machine comprising a base, cutter means movably mounted on the base, means for moving the cutter means reciprocably along the base to carry out a cutting operation, means for altering the height of the cutter means relative to the base, and control means on the base cooperable with the cutter means for controlling the height alteration means to set a desired height of the cutter means relative to the base as the cutter means passes the control means.

The base may comprise a plurality, and preferably a multiplicity of segments, adjacent segments being joined together but able to move vertically relative one to another.

In the case where the base is not segmented, the control means preferably comprises a pair of control elements, one at or adjacent each end thereof such that the cutter means height can be altered at the end of each traverse.

Where the base is segmented into n segments, the control means preferably comprises n+1 control elements such that there is a control element at or adjacent the ends of each segment such that the height of the cutter means can be altered individually for each segment in each traverse direction.

Alternatively, the control means may comprise control elements spaced less frequently such that the cutter means height will remain unchangeable over a length of two or more segments during each traverse. Each control element may be a signalling element for giving a signal to the cutter means height alteration means.

The cutter means height alteration means preferably includes lifting means operating to pivot a cutter means support about a pivotal mounting point spaced from the lifting means. The lifting means is preferably a hydraulic jack.

The cutter means is preferably mounted on a multiplicity of wheels for movement along the base. There is preferably one wheel at the face side of the cutter means and two or more wheels being spaced apart on the goaf side of the cutter means. Said wheel at the face side preferably lies beneath the pivotal mounting point of the cutter means support.

The cutter means is preferably arranged to cut clear of the base at one end of its traverse, giving the advantage that a roadway on one side of the cutting path need be formed prior to operation of the cutting means.

The signalling element may be electrical, for example an electrical switch, electromechanical, for example a member movable in the base adapted to operate an electrical switch on the cutter means, or preferably a cam, for example a two-position cam, on the base which cooperates with a hydraulic valve on the cutter means to control a hydraulic circuit either to raise or lower the cutter means. Alternatively, the signal to the cutter means height alteration means may be given magnetically, by varying the strength, polarity or frequency of a magnetic field. A further alternative would be to use an optical method, where optical sensing means on the cutter means would read a signal or indicator set on the base.

The base preferably includes conveyor means for conveying material cut from the face by the advancing machine. The conveyor is preferably mounted to provide adequate clearance from the bottom of the base to avoid interference when movement takes place over an undulating floor.

The cutter means preferably has a cutting depth of cut of less than 12 inches (30.48 cm), and conveniently has a cutting depth of 3 inches (7.62 cm).

The cutting means can preferably occupy either an upper or a lower position relative to the base, in accordance with an indication from the control means. In the upper position, the cutter means preferably cuts such that the floor of the cut lies above the floor on which the base stands, and in the lower position, the cutter means preferably cuts such that the floor on which the base stands lies above the floor of the cut.

The variation in floor height between successive floor cuts is preferably less than one inch (2.54 cm) and preferably in the region of 0.25 inch (0.62 cm). In this way, the machine is able to advance up the small step created by a rise in floor level, and the machine and particularly the conveyor will remain clear of the floor if the floor level is cut to descend.

For ease of climbing, the cutter means may have an angled lower edge to provide an upwardly sloping floor. The cutter means preferably has a circular cutting head, and chamfering the profile of the cutting head conveniently allows creation of the upwardly sloping floor.

The machine preferably includes toe plate means to provide a leading edge for the base. The width of the toe plate means is preferably less than the depth of cut of the cutter means at one traverse.

According to a further aspect of the invention, there is provided a method of cutting into a face using a cutting machine according to the invention, which method comprises the steps of setting the control means in an initial state to control the cutter means height alteration means in a desired sequence, carrying out continuous cutting of the face by traversing the cutter means and advancing the base, monitoring the progress of the cutting machine in relation to the cutting path to be followed, and altering if necessary the control means setting to alter the height of the cutter means relative to the base to alter the cutting path.

Where the base is segmented, the control means may be altered such that the cutting path at individual segments can be controlled to allow for local irregularities in, for example a coal seam profile, movement of individual segments taking place within the jointing constraints between adjacent segments.

By way of example, embodiments of a cutting machine and a method of cutting according to the invention will now be described with reference to the accompanying drawings, in which:

FIG. 1 is a diagrammatic side view of part of a cutting machine according to the invention;

FIG. 2A is a side view illustrating cutting above the base level;

FIG. 2B is a side view illustrating cutting below the base level;

FIG. 3D illustrates how instability can arise on conventional equipment;

FIG. 3E illustrates a series of alternating cuts;

FIG. 4 illustrates diagrammatically height alteration means for the cutter means;

Figure 3A:
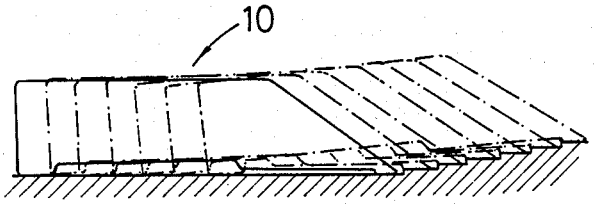
FIG. 3A illustrates diagrammatically a climbing profile.

FIG. 1 shows diagrammatically a cutting machine 10 according to the invention with part of cutting element 11 not shown. The cutting machine 10 has a base 12 along which an endless conveyor means (usually a chain) runs, an upper conveying surface running in space 13 and the return portion of the conveyor running in the space 14. Material cut from face 15 falls behind the cutting element 11 and onto the conveyor, if necessary up ramp surface 16. The cutting element 11 in this embodiment is a circular, rotating element driven by a motor and gear box 17 via a shaft 18, the motor and gear box 17 being mounted in a housing 19 which also includes drive means for traversing the housing and associated cutting element 11 reciprocably above the base 12.

This embodiment of the invention is particularly applicable to long face workings and a base 12 some hundreds of feet long may be necessary, conveyors extending the whole length of the base 12 and feeding material to a convenient central point where a rearwardly extending conveyor passes material away from the face 15.

The cutting element is designed to machine from the face 15 a strip parallel to the conveyor track extending from the floor to a significant height, in practice not less than two feet but possibly considerably more, and of a narrow width, conveniently up to 12 inches (30.48 cm). For the purpose of this example, the depth of cut will be taken as a preferred depth of 3 inches (7.62 cm).

For long base lengths, the base is divided into segments which will be referred to hereinafter as pan lengths. Adjacent pan lengths are joined together in such a way as to provide for limited movement between adjacent pan lengths to allow pivoting horizontal movement between adjacent pan lengths and some pivoting vertical movement between adjacent pan lengths.

The base 12 incorporates ramp plates 20 throughout the cutting length to provide the ramp surface 16. Each ramp plate 20 includes a toe plate 21 extending below the level of the underside of the base 12 to carry the weight of the conveyor and cutting machine at a leading edge. The front to rear width of the toe plate 21 should preferably be less than the width of the cutting web so that the toe plate can lie fully within each width cut by the cutting element 11.

The cutting element 11 is arranged to be positionable vertically in different positions relative to the base 12. In the particular embodiment, the cutting element 11 is positionable in either an upper or a lower position. FIG. 2A shows cutting taking place with the cutting element in the upper position and FIG. 2B shows cutting taking place with the cutting element 11 in the lower position. As can be seen in FIG. 2A, a step to be climbed by the toe plate 21 is formed and, as shown in FIG. 2B, an undercut is provided ahead of the toe plate 21. The cutting element 11 is arranged to make its cut adjacent (in the range 0 to 2 inches) to the leading edge of the toe plate 21 and arranged so that the floor level is cut in the range 0 to 1 inch above or below the level of the base of the toe plate 21.

If the cutting element 11 is maintained in the upper cutting position, it will be appreciated that the cutting machine 10 will gradually climb and that if the cutting element 11 is in the lower position as the cutting machine advances, the cutting machine 10 will gradually descend. FIG. 3A illustrates diagrammatically a gradual climb, this drawing showing just ramp plate 20 behind which the cutting machine 10 follows.

Figure 3B:
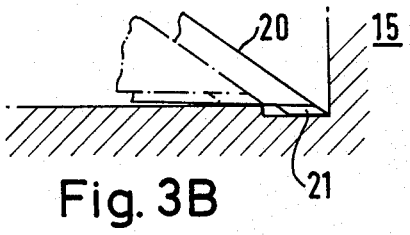
FIG. 3B illustrates a downward cutting increment.
Figure 3C:
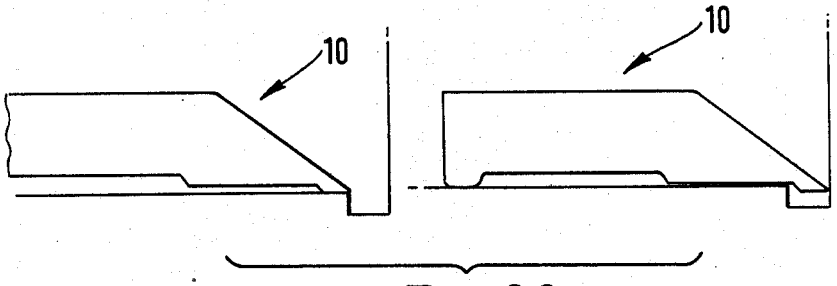
FIG. 3C illustrates the relationship between toe plate depth and undercut depth.

FIG. 3B illustrates in detail movement of the toe plate 21 into an undercut and shows that the depth of the undercut should be less than the depth of the toe plate 21 to avoid instability in constant descent. It will be appreciated from FIG. 3C that if descent is continuous with an undercut deeper than the depth of the toe plate 21, instability will eventually result.

FIG. 3D illustrates the problem mentioned above concerning instability with the more conventional "wide web" equipment where the step in the floor locates under the centre of the conveyor upon advance of the cutting machine, thereby trapping the return conveyor portion. If cutting were to continue as shown in FIG. 3D, serious machine and track instability would result, because the weight and cutting force reactions are carried to the floor through a fulcrum rather than widely set feet.

The rate at which the machine 10 will climb, (provided that the ramp plate 20 can negotiate a step in the floor ahead of it) will be the ratio between increment of lift to the width of the effective cutting web. Thus for an example with a lift of 0.25 inch (0.62 cm) with a 3 inch (7.62 cm) web, the rate of lift will be 1:12. Similar considerations apply to a rate of dip.

In order to maintain its existing horizon, within narrow limits, if alternate cuts are made with the cutting element 11 in upper and lower positions, it will be appreciated that the horizon is maintained essentially the same. Thus on a traverse to the left, the cutting element 11 might be in the upper position and on a traverse to the right, the cutting element might be in a lower position. FIG. 3E illustrates a series of alternating upper and lower position traverses.

For movement of the cutting element 11 between upper and lower positions 0.5 inch (1.27 cm) apart, a convenient way of achieving movement is by arranging for the shaft 18 on which the cutting element 11 is mounted to be supported on a pivotable support. FIG. 4 illustrates a suitable arrangement where the housing 19 is pivotally mounted at one end and at the other end is supported by a hydraulic jack 30. Extension or contraction of the hydraulic jack 30 will thus alter the height of the cutting element 11. Because the movement involved is small, the time involved to effect movement through the hydraulic jack is also small and can realistically be designed to take place in periods of less than one second.

As indicated above, for long lengths of face to be cut, the base 12 can extend over several hundred feet, in which case the base 12 is segmented with adjacent pan lengths being joined in articulated manner. The characteristic of being able to adjust height of the cutting element 11 quickly makes it possible with narrow web equipment to arrange control of height to be transmitted in short lengths of travel on the basis of either lift and hold that position or lower and hold that position, which can conveniently be related to each conveyor pan length.

Figure 5:
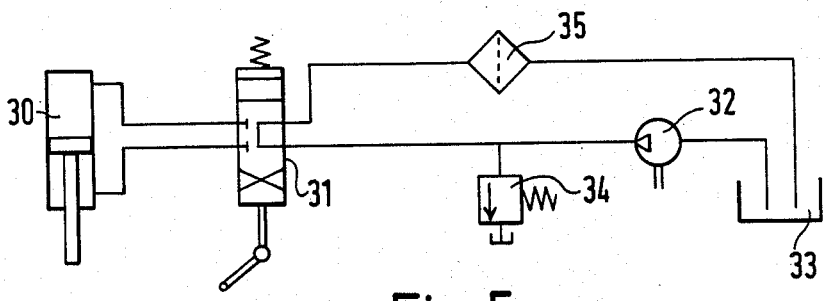
FIG. 5 shows a hydraulic circuit for height control.

Arrangement of control for height positioning of the cutting element 11 can be achieved in a variety of ways already mentioned. A preferred arrangement is for height control to be achieved hydraulically, the preferred arrangement being such that at one end of each conveyor pan length of the base 12 an adjustable two position mechanical cam is arranged in the path of the traversing housing 19 and cutting element 11 which operates a two way and neutral, closed centre hydraulic valve for controlling hydraulic flow to the hydrualic jack 30 arranged to control the posture of the cutting element 11. FIG. 5 illustrates a hydraulic circuit where the jack 30 is extended or contracted depending on the position of valve 31, which position is determined by the cam position. Power for the hydraulic jack 30 is supplied in a standard circuit including a pump 32 fed from a tank 33, the circuit including a relief valve 34 and a filter 35. Having passed the cam, the hydraulic valve 31 will return to neutral and the hydraulic fluid in the cylinder is thus locked in and will hold the machine in that posture until the next cam is reached and another signal provided. If the next signal is to reverse the position, the requisite flow will take place and again be locked in after passage of the cam. If the next signal is the same as before, the fluid in the cylinder of the jack 30 will be topped up (if any leakage has taken place) and the remainder of the pump flow will be returned to the tank 33 via the pressure relief valve 34. Again, after passage of the cam, the fluid is locked in to the cylinder. When the valve is in the neutral position, the hydraulic flow in the circuit is arranged to return unimpeded to the tank 33.

Figure 6:
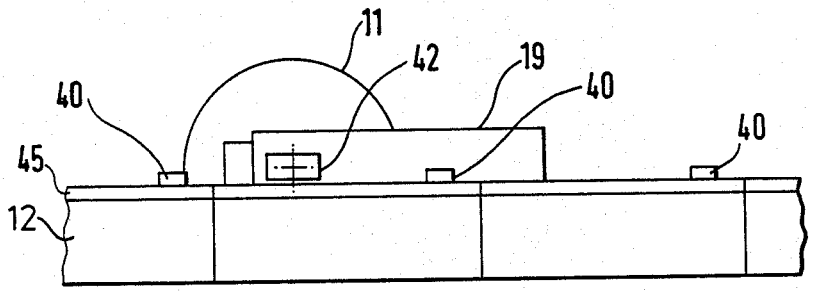
FIG. 6 is a rear view of a cutting machine.

It is normal for any machines of this type to have a spill plate at the top of the conveyor track and signalling cams 40 are conveniently arranged on the top rail of the spill plate as illustrated in FIG. 6. The housing 19 carries a cam signal detector unit 42 adapted to engage the cams 40 and as the housing 19 traverses, signals from the cams 40 will, via the hydraulic circuit, control movement of the cutting element 11. The spill plate top rail has reference 45.

The signals given by the cams 40 will establish the height of the cutting element 11 until the detecting device 42 encounters a cam which gives a contrary signal. In order to be able to control the height of the cutting machine at each pan length, it is necessary to have a cam 40 on each flexibly connected conveyor pan length so that individual adjustments to the cutting horizon can be made in respect of each pan length. It will be appreciated also that the pan length at each end will need to have a cam on the outside ends in order to allow control of the end pan lengths. Thus for n pan lengths, n+1 cams will be required.

As the cutting element 11 and housing 19 are moving backwards and forwards along its track, cutting in both directions, the signal given by a particular cam 40 will relate to the next pan length. Thus, in one direction, the cam signal will relate to the length to its left whilst in the other direction, it will relate to the length of cutting to its right. If all the cams 40 in a particular length are signalling the same posture, this feature will have no effect and the pan lengths concerned will either rise continuously or fall continuously depending on the position selected. If, however, the cams 40 are signalling alternate postures, the cutting horizon in front of each pan length will alternate between rise and dip and the existing horizon for the group of pan lengths will be maintained the same.

If, however, the cams at each end of a particular pan length are in the same position, that pan length will always rise or fall depending on whether the cams are up or down.

Figure 7:
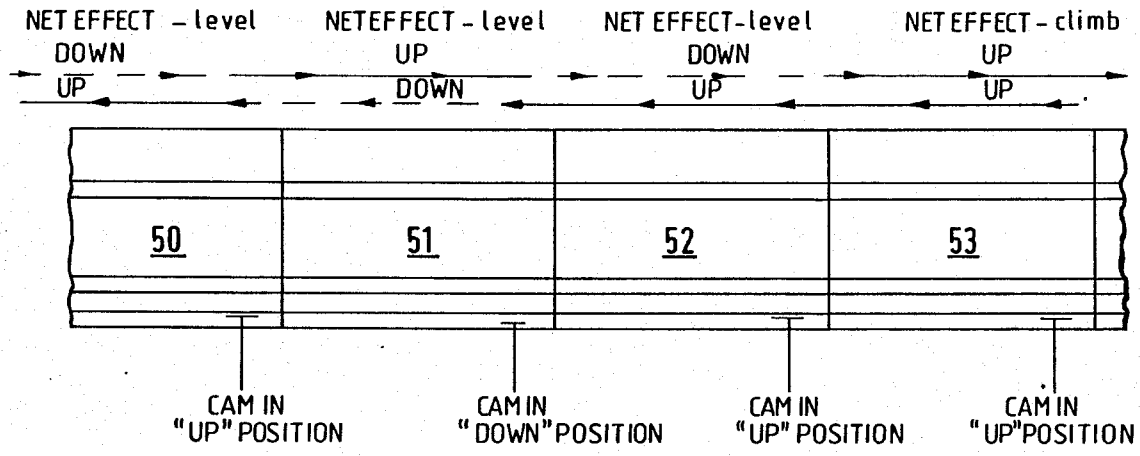
FIG. 7 is a diagram illustrating a part of a cutter traverse.

FIG. 7 illustrates a pan section showing four pan lengths and four cams and it can be seen that pan lengths 50, 51 and 52 will maintain the same horizon but pan length 53 will continue to rise.

In this way, a track mounted cutting element 11 can be used to steer the entire cutting machine assembly by preprogramming signals on the cams 40. The control is easily effected by alteration of the cam positions such that a requirement for part of the machine assembly to climb is achieved by setting adjacent cams in the climb position, a requirement that the machine assembly should dip is achieved by setting adjacent cams in the dip position and a requirement that the machine should maintain its existing horizon is achieved by setting adjacent cams in alternate positions. As the assembly progresses, adjustments to the cam positions can be made to adjust the horizon of different pan lengths to conform accurately to the seam ahead of the machine.

The two positions of the cams 40 are preferably readily distinguishable, for example by providing a red display surface when the cam is in the climb position and a white display surface when the cam is in the dip position.

Certain practical factors need to be taken into account, notably:

1. The ability of the ramp plate to climb steps in the floor produced by raising the cutting head.

2. A tendency in some conditions for the toe of the ramp plate to ride on a small bed of fines and thus modify the desired steering characteristic.

3. The ability of the equipment to negotiate a change in horizon attitude without interference by the floor profile with the underside of the conveyor track (which could impede the performance of the conveyor or even cause it to stall or cause machine track instability or both).

Figure 8A:
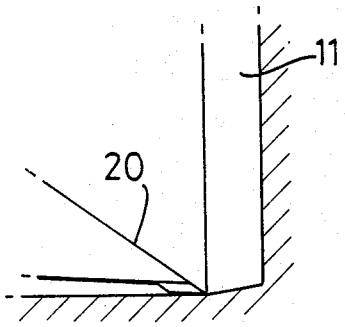
FIGS. 8A and 8B illustrate a chamfered cutting profile.
Figure 8B:
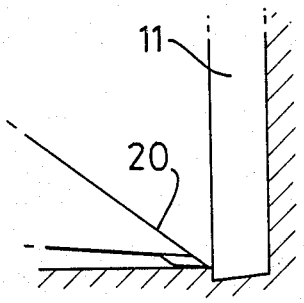

With regard to point (1) above, in order to avoid difficulty in climbing steps, it is preferred that the cutting element 11 will have its cutting profile marginally changed to provide a sloping surface presented to the ramp plate 20. The arrangement is illustrated in FIGS. 8A and 8B, and shows that the floor profile slopes upwardly in the climb position so that no step is presented to the ramp plate 20. This causes a slightly deeper undercut in the dip position but this presents no real problem.

With regard to (2) above, the effect of fines beneath the toe plate 21 will be to bias the characteristic towards climb. The problem will vary with the nature of the mineral cut, the sharpness of the leading edge of the toe plate 21 which will deteriorate with use and wear, and the weight on the toe. In order to adjust the bias, it would be necessary to modify the increments of undercut and overcut to bias towards undercut. Such an adjustment will be made possible by arranging for a fine adjustment of the positioning of the hydraulic jack 30 which controls the posture of the cutting element 11.

Figure 9:
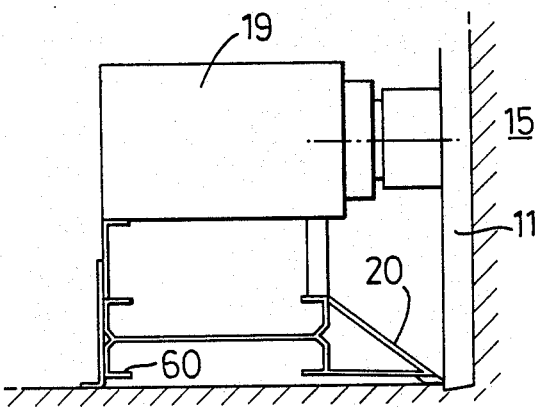
FIG. 9 is a side view of a modified cutting machine according to the invention.

With regard to (3) above, some combinations of change in horizon can lead to instability of the conveyor/machine track and interference with the passage of the conveyor return strand. This situation may arise when changing to dip and has been discussed previously with reference to FIGS. 3C and 3D. This problem can be lessened by keeping the rate of climb and dip modest and by incorporating into the design adequate clearances between the conveyor track by proper design of the ramp plate 20. The effect of clearances can also be improved by lifting rear edge 60 of the conveyor as shown in FIG. 9.

The principles of operation of a machine according to the invention having been described, a preferred embodiment will now be described with reference to FIGS. 10 to 16.

Figure 11:
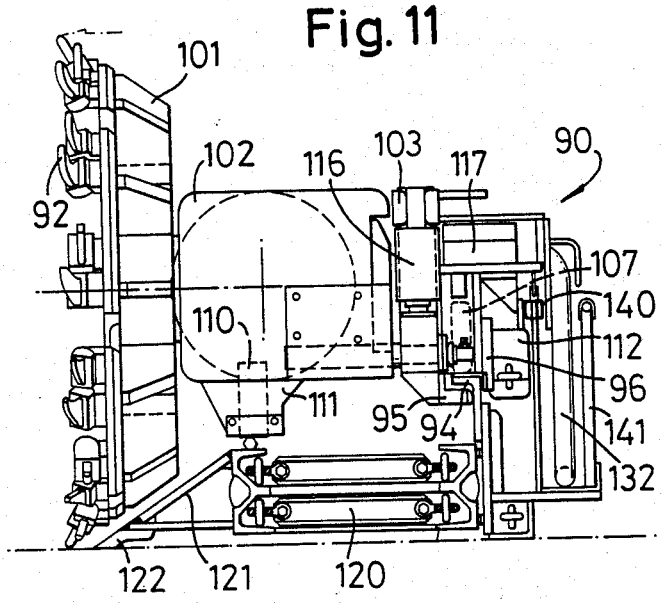
FIG. 11 is a view from the left of FIG. 10.
Figure 12:
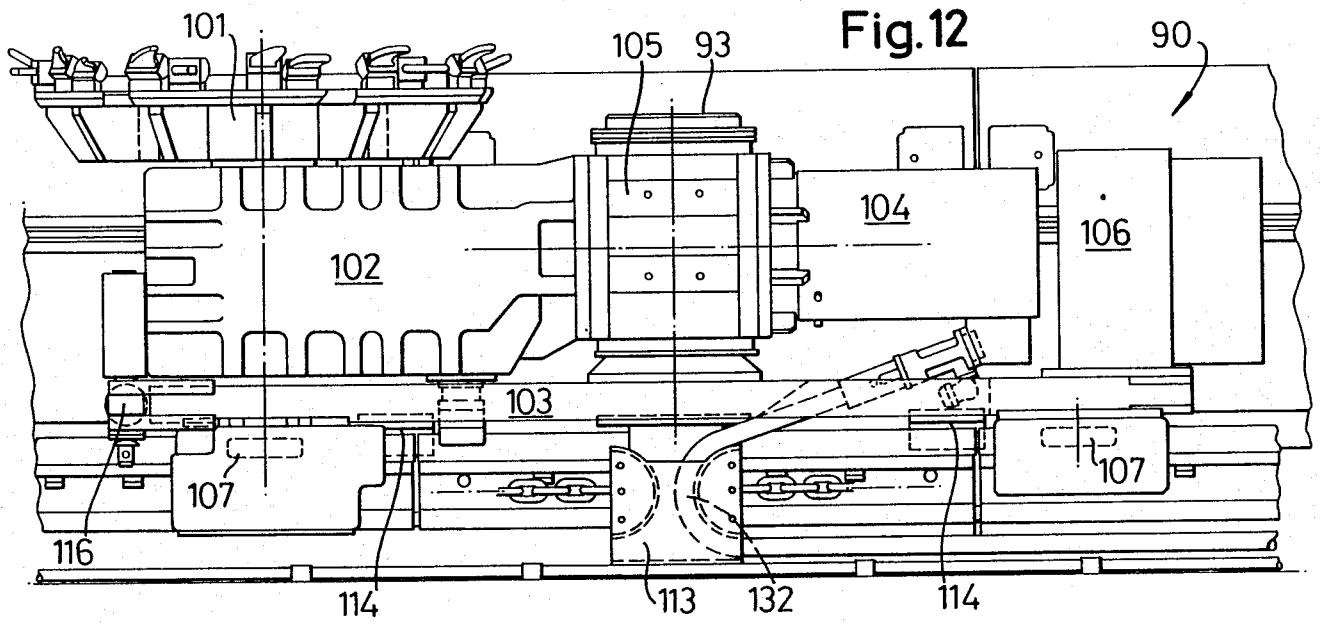
FIG. 12 is a plan view of the machine of FIGS. 10 and 11.

A cutting machine generally indicated at 90 is movably supported on a base consisting of a multiplicity of base segments 91. The machine 90 has a rotatable cutting head 101 including a multiplicity of peripherally arranged blades 92. As can be seen in FIG. 11, the blades 92 cut into a coal face with a chamfered profile which provides a slight upward slope in a forward direction, thereby easing travel of the machine 90 when climbing.

The cutting head 101 is mounted on a horizontal shaft (not shown) driven by a cutter motor 104 via a cutter gearbox 102. The cutter motor 104, cutter gearbox 102 and cutting head 101 form a unitary assembly, the assembly being pivotally mounted on a cutter main frame 103, pivotal mounting being by way of a cylindrical tube 93 cantilevered outwardly from the frame 103 in which the assembly is journalled by means of a tubular pivot housing 105. A drive shaft from the motor 104 to the gearbox 102 passes through the tube 93 and the housing 105.

Pivotal movement of the cutter assembly about the tube 93 is achieved by a hydraulic ram 116, the top of the ram 116 being mounted on the frame 103 and the bottom of the ram being mounted on the cutter assembly. The control arrangement for the ram 116 will be described later but provides for the ram 116 to be in one of two states, namely extended or contracted, and therefore causing the cutter head 101 to be raised or lowered respectively with respect to the frame 103. The ram 116 in this particular embodiment has a piston diameter of 4 inches (10.16 cm) and is designed to alter the cutting head 101 from dip to climb in 0.4 seconds, and from climb to dip in 0.16 seconds. The stroke is such that the vertical distance between the upper and lower positions of the cutter head 101 is 0.5 inches (1.27 cm). Some adjustment of tube figures may be made. It will be appreciated also that the ram could be arranged to lie in a neutral, central position with suitable hydraulic control, but it is simpler to have the ram either extended or contracted, in which case to achieve a horizontal path at a particular segment 91 of the base, it is necessary to cause the cutter head 101 to travel in its upper position in one direction over that segment, and in its lower position in the reverse direction over that segment. As described earlier, it will be appreciated that the segments 91 are connected together in such a way as to allow relative movement therebetween.

A hydraulic pump 115 and hydraulic fluid reservoir 106 are provided for the ram 116 control and other hydraulics.

The frame 103 runs on the base segments 91 on three wheels, there being two goaf side wheels 107 and one face side wheel 110: the goaf side wheel 107 at the cutter end is supported by a mounting 108 and the goaf side wheel at the trailing end is supported by a mounting 109. The face side wheel 110 is supported by a mounting 111. The goaf side mountings 108 and 109 also engage the base segments 91 to prevent forward, rearward or upward movement of the frame 103 relative to the base segments 91. This is achieved by providing a horizontal flange 94 on each base segment 91, the goaf side mountings 108 and 109 each having a horizontal flange 95 lying beneath the segment flange 94 and a rear plate 96 lying behind the segment flange 93.

Figure 13:
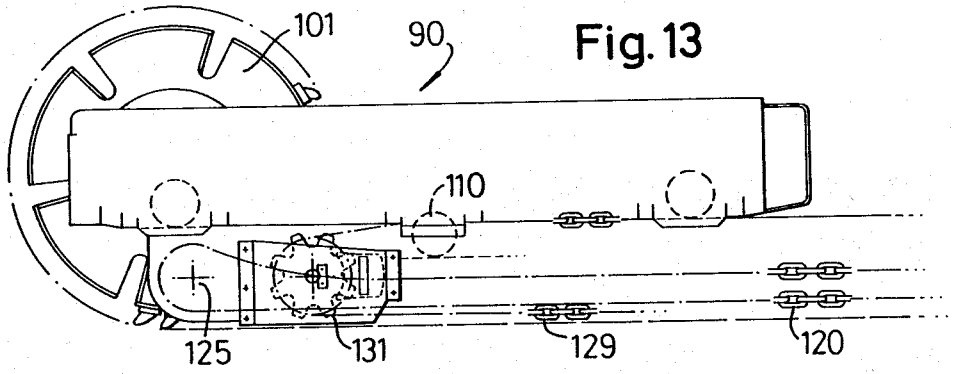
FIG. 13 is a rear view of the machine of FIGS. 10 to 12 at the leftmost end of its travel.
Figure 14:
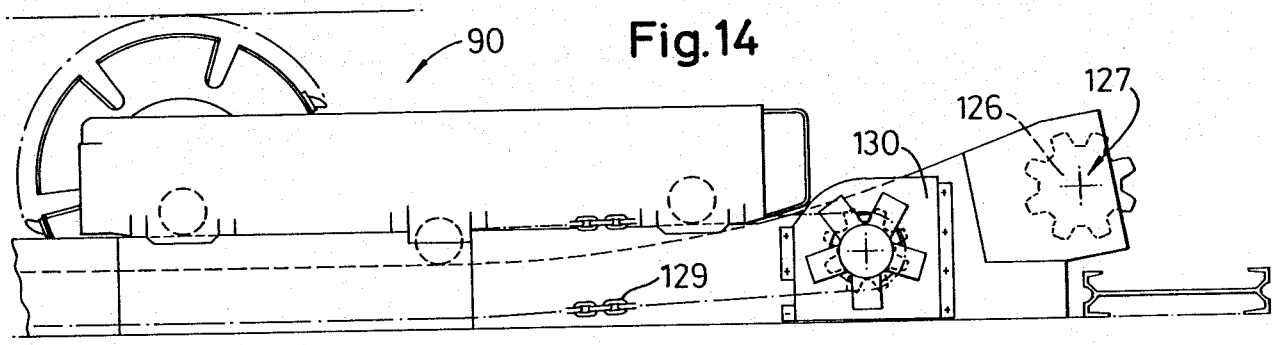
FIG. 14 is a rear view of the machine of FIGS. 10 to 13 illustrating conveyor and haulage drives.

Movement of the frame 103 along the segments 91 is achieved by a haulage chain 129 clamped to the frame 103 by a haulage chain clamp 112, the chain 129 being driven by a haulage chain drive 130 (FIG. 14), the chain 129 remote from the drive unit 130 passing over a chain return and unit 131 (FIG. 13).

Figure 10:
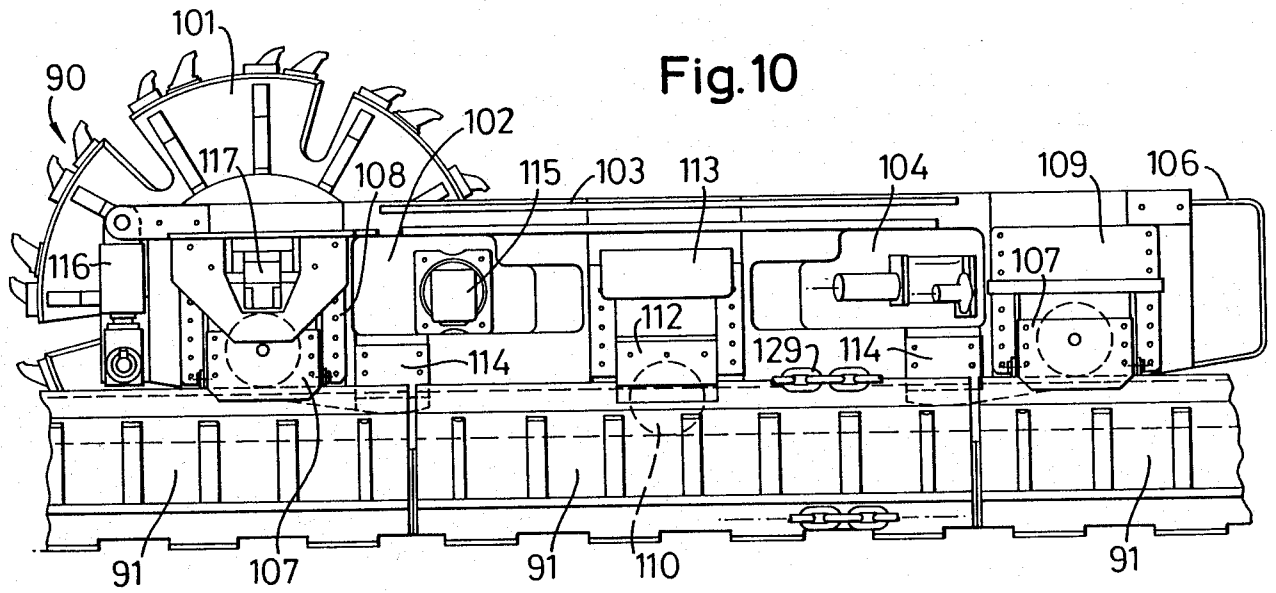
FIG. 10 is a rear view of a preferred embodiment of a cutting machine according to the invention.

As can be seen in FIGS. 10 and 13, the face side wheel 110 lies directly beneath the pivotal mounting of the cutter assembly on the frame 103. This is clearly advantageous since it means that the cutter head height is determined in accordance with the height of the central height of the machine as set by the face side wheel 110. Had there been two face side wheels, one at each end of the machine, height control of the machine would be significantly more variable since the cutter head portion would vary also in accordance with variations in segment slope and relative segment heights.

The base carries a chain driven conveyor 120 for conveying material cut from the coal face to a desired point. As can be seen in FIG. 11, material is caused to rise up angled plates 121 which lead from the base segment toe plates 122 and on to the conveyor 120. The chain of the conveyor 120 is driven by a drive assembly 127 (FIG. 14) including a motor, gearbox, chain tensioner and coupling, on a drive frame including a sprocket 126. A chain return unit 125 is provided at the undriven end of the base (FIG. 13).

Height control is achieved by a sensor unit 117 which is operated by two positive cams 140 mounted on the base spill plate of the base segments 91. Details of the sensor unit and cam operation will be described in more detail with reference to FIGS. 15 and 16. Behind the spill plate is a rear cover 141 defining with the spill plate a channel for protecting necessary services such as hydraulic or electric cable and hoses 132.

As can be seen in FIG. 13, the arrangement of the cutter head assembly is such that at the leftward extend of its travel, the cutting head 101 cuts beyond the furthest base segment 91 and the chain returns 125 and 131. Thus, a roadway need not be formed at the leftward end of the machine prior to advancement. This represents a significant advantage over traditional arrangements where a roadway along each side was required.

Figure 15:
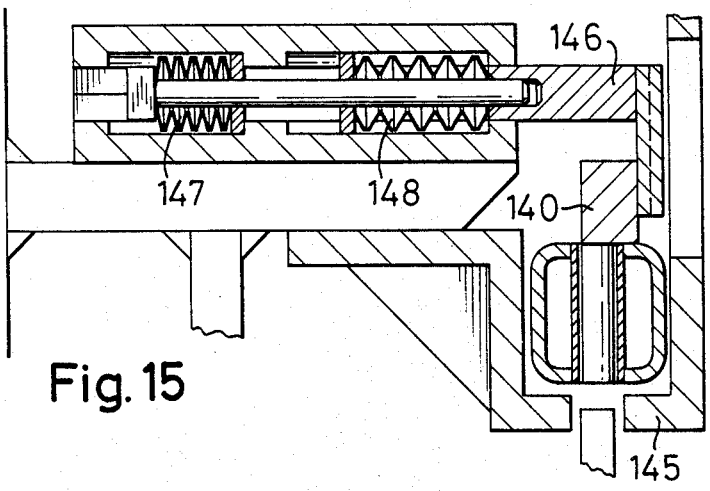
FIG. 15 is a sectional elevation of a cam and cam follower arrangement for hydraulic control.
Figure 16:
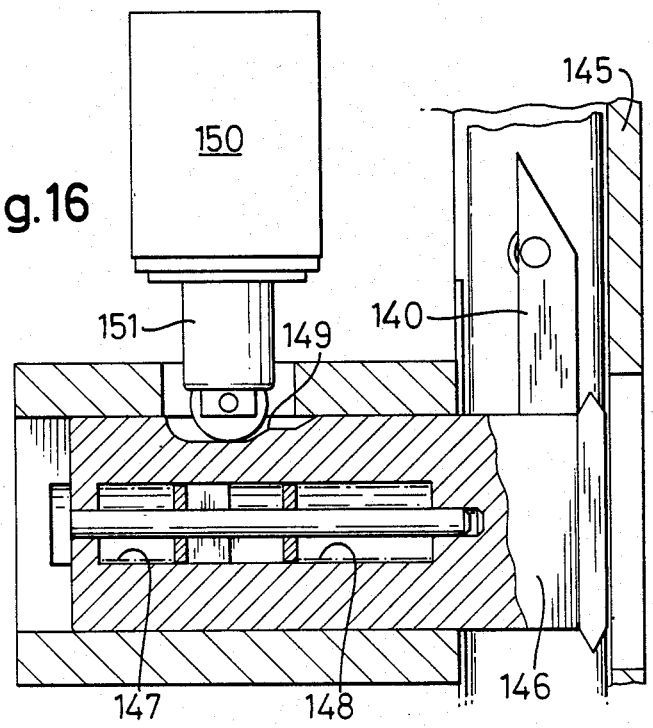
FIG. 16 is a sectional plan view of the arrangement of FIG. 15.

Turning to FIGS. 15 and 16, a cam 140 positionable by rotation in one of two positions, the cam 140 being mounted in a support 145.

The moving cutter frame 103 has mounted on it a cam follower 146 capable of rectilinear movement, and biased towards a central position by resilient means, in the drawing shown as Belleville washers 147, 148 but equally, coil springs could be used.

In the position of the cam follower 146 shown in FIGS. 15 and 16, the follower 146 is pulled outwardly, and the profiled portion 149 thereof is such that hydraulic valve 150 has its piston 151 out also. In the central position of the cam follower 146, the piston 151 is in a neutral position, and with the cam 140 reversed, the profiled piston 149 causes the piston 151 to be pushed into the valve 150. The valve is as shown in FIG. 5, reference 31, and the operation of the ram 30, equivalent to the ram 116, can thus be seen. The principle of operation of the machine is as already described.

It will be appreciated that the foregoing description is by way of example only and that modifications and alterations may be made within the scope of the invention.

I claim:

1. A cutting machine comprising a base segmented into a multiplicity of segments, cutter means movably mounted on the base, means for moving the cutter means reciprocably along the base to carry out a cutting operation, means for altering the height of the cutter means relative to the base and a multiplicity of control means on the base segments cooperable with the cutter means for controlling the height alteration means to set a desired height of the cutter means relative to the base as the cutter means passes each control means, there being n segments in the base, and n+1 control means, each control means lying in an end region of an associated segment and being settable by an operator in one of two states, namely a first state in which the cutting means is caused to traverse the segment after the particular control means in an upper position relative to said segment and a second state in which the cutting means is caused to traverse the segment after the particular control means in a lower position relative to said segment, whereby the profile path to be cut by the cutting machine can be pre-programmed by pre-setting each control means in a desired one of said two states, and the path to be cut can be adjusted during operation by altering the state of one or more of said control means.

2. A cutting machine as claimed in claim 1 wherein the cutter means height alteration means includes lifting means operating to pivot a cutter means support about a pivotal mounting point spaced from the lifting means.

3. A cutting machine as claimed in claim 2 wherein the lifting means is a hydraulic jack.

4. A cutting machine as claimed in claim 2 wherein the cutter means is mounted on a multiplicity of wheels for movement along the base, there being one wheel at the face side of the cutter means, said one wheel at the face side lying beneath the pivotal mounting point of the cutter means support.

5. A cutting machine as claimed in claim 4 comprising two or more wheels spaced apart on the goaf side of the cutter means.

6. A cutting machine as claimed in claim 1 wherein the cutter means is arranged to cut clear of the base at one end of its traverse.

7. A cutting machine as claimed in claim 1 wherein the control means comprises signalling elements.

8. A cutting machine as claimed in claim 1 wherein the signalling elements are electrical switches.

9. A cutting machine as claimed in claim 7 wherein the signalling elements are electromechanical.

10. A cutting machine as claimed in claim 7 wherein each signalling element is a cam on the base which cooperates with a hydraulic valve on the cutter means to control a hydraulic circuit to control the height of the cutter means.

11. A cutting machine as claimed in claim 7 wherein the signal to the cutter means height alteration means is given magnetically, by varying a magnetic field.

12. A cutting machine as claimed in claim 7 wherein the signalling elements operate optically.

13. A cutting machine as claimed in claim 1 wherein the base includes conveyor means for conveying material cut from the face of the advancing machine.

14. A cutting machine as claimed in claim 13 wherein the conveyor is mounted to provide adequate clearance from the bottom of the base to avoid interference when movement takes place over an undulating floor.

15. A cutting machine as claimed in claim 1 wherein the cutter means has a cutting depth of cut of less than 12 inches.

16. A cutting machine as claimed in claim 15 wherein the cutter means has a cutting depth of three inches.

17. A cutting machine as claimed in claim 1 wherein, in the upper position, the cutter means cuts such that the floor of the cut lies above the floor on which the base stands, and in the lower position, the cutter means cuts such that the floor on which the base stands lies above the floor of the cut.

18. A cutting machine as claimed in claim 17 wherein the variation in floor height between successive floor cuts is less than one inch.

19. A cutting machine as claimed in claim 18 wherein the difference in floor height between successive cuts of the cutter means in the same position is in the region of 0.25 inches.

20. A cutting machine as claimed in claim 1 wherein the cutter means has an angled lower edge to provide an upwardly sloping floor.

21. A cutting machine as claimed in claim 1 wherein the cutter means has a circular cutting head having a chamfered profile to allow creation of an upwardly sloping floor.

22. A cutting machine as claimed in claim 1 including toe plate means to provide a leading edge for the base.

23. A cutting machine as claimed in claim 22 wherein the width of the toe plate means is less than the depth of cut of the cutter means at one traverse.

24. A cutting machine as claimed in claim 1 wherein adjacent segments are joined together but able to move vertically relative to one another.

25. A method of cutting into a face using a cutting machine having a segmented base, cutter means movably mounted on the base, means for moving the cutter means reciprocably along the base to carry out a cutting operation, means for altering the height of the cutter means relative to the base and a multiplicity of control means of the base segments cooperable with the cutter means for controlling the height alteration means to set a desired height of the cutter means relative to the base as the cutter means passes each control means, there being n segments and n+1 control means, each control means lying in an end region of an associated segment and being settable in one of two states, namely a first state in which the cutting means is caused to traverse the segment after the particular control means in an upper position and a second state in which the cutting means is caused to traverse the segment after the particular control means in a lower position, which method comprises the steps of:

(a) pre-programming the machine by pre-setting each control means in a desired one of said two states, (b) carrying out continuous cutting of the face by traversing the cutter means and advancing the base, (c) monitoring progress of the cutting machine in relation to a path to be followed, (d) altering the state of one or more control means as necessary to adjust the cutting path.

* * * * *